US007891494B2

(12) United States Patent
Smith

(10) Patent No.: US 7,891,494 B2
(45) Date of Patent: Feb. 22, 2011

(54) LIGHT WEIGHT PRODUCT CUSHIONING DEVICE

(75) Inventor: Forrest Smith, Santa Anna, CA (US)

(73) Assignee: Reflex Packaging, Inc., Santa Anna, CA (US)

( * ) Notice: Subject to any disclaimer, the term of this patent is extended or adjusted under 35 U.S.C. 154(b) by 0 days.

(21) Appl. No.: 12/190,115

(22) Filed: Aug. 12, 2008

(65) Prior Publication Data

US 2009/0045098 A1 Feb. 19, 2009

Related U.S. Application Data

(60) Provisional application No. 60/955,693, filed on Aug. 14, 2007.

(51) Int. Cl.
*B65D 81/02* (2006.01)
*B65D 81/05* (2006.01)

(52) U.S. Cl. ..... 206/594; 206/592; 206/586; 206/523

(58) Field of Classification Search ..... 206/521, 206/523, 586, 587, 591–594, 320
See application file for complete search history.

(56) References Cited

U.S. PATENT DOCUMENTS

| | | | | |
|---|---|---|---|---|
| 5,624,037 | A * | 4/1997 | Kozo | 206/565 |
| 5,722,628 | A * | 3/1998 | Menaged | 248/441.1 |
| 5,806,683 | A * | 9/1998 | Gale | 206/587 |
| 6,010,007 | A * | 1/2000 | Moren et al. | 206/587 |
| 6,142,304 | A * | 11/2000 | Moren et al. | 206/587 |
| 6,345,720 | B1 * | 2/2002 | Redden et al. | 206/725 |
| 6,588,595 | B2 * | 7/2003 | Levin et al. | 206/589 |
| 6,968,954 | B2 * | 11/2005 | Hsieh | 206/587 |
| 7,134,553 | B2 * | 11/2006 | Stephens | 206/589 |
| 7,584,851 | B2 * | 9/2009 | Hong et al. | 206/589 |
| 2004/0020820 | A1 * | 2/2004 | Stephens | 206/587 |
| 2008/0067105 | A1 * | 3/2008 | Pitt | 206/587 |

* cited by examiner

*Primary Examiner*—David T Fidei
(74) *Attorney, Agent, or Firm*—Laubscher & Laubscher, P.C.

(57) ABSTRACT

Disclosed is a unitary product cushioning device for supporting shock sensitive products during transport in an exterior container, comprising a product support region having a platform; a flap hingedly connected on either side of the product support region for folding upwards and towards the product support region; a plurality of ribs on each flap and product support region, the ribs defining product-supporting cavities therebetween for receiving and supporting the products; a cutout between each flap and product support region. Fold stops may hingedly connect each flap and product support region, the fold stop being angled to facilitate folding of the flap towards the product support region to form a generally "U" shape in the exterior container.

8 Claims, 5 Drawing Sheets

LIGHT WEIGHT PRODUCT CUSHIONING DEVICE

CROSS-REFERENCE TO RELATED APPLICATION

This application claims the benefit of U.S. Provisional Application No. 60/955,693 filed Aug. 14, 2007, incorporated by reference herein.

FIELD OF THE INVENTION

This invention relates to product cushioning devices for use in packaging shock sensitive products, such as various types of electronic devices. In particular, the invention relates to a light-weight cushioning device made from a moldable, resilient plastics material.

BACKGROUND OF THE INVENTION

The use of product cushioning devices for shock sensitive products has been known for many years. Such devices are used for protecting the shock sensitive products in the event that they are dropped or mishandled during shipping. Some examples of product cushioning devices include tissue paper, shredded paper, bubble-pack and molded foamed polystyrene pellets.

As the requirement for better packaging and cushioning became more demanding, for example with the introduction to the market of complicated and expensive electronics devices such as hard drives, printed circuit boards, and the like, the requirement arose for more sophisticated and better shock absorbing cushioning devices.

This has given rise to the use of such products as honeycomb cardboard, and particularly foamed polystyrene, foamed polyurethane, foamed polypropylene, or foamed polyethylene.

Also known are packaging devices useful for shipping electronic devices such as hard drives in bulk from manufacturing to assembly points. Most US electronics companies now purchase both completed hardware and components from the Far East. Due to a number of reasons, these items are often shipped via air freight rather than ocean shipping. Thus, the overall shipping weight is a critical component of cost. Foam packaging has traditionally been the lowest weight material to package these items and hence offers the lowest additional shipping costs when shipped by air. Thermoformed cushioning has a number of inherent benefits which foam cannot offer, however, they do not typically offset the lower shipping costs obtained by using foam packaging materials. Foam materials include PP, PE, PU, PS, and mixes thereof. Thermoformed cushions are typically made from PE sheet.

None of the existing thermoformed cushions has been able to match foam in a comparison of weight to performance. Thermoformed cushions weigh too much to compete with foam when air shipping charges are considered. This is because foam by nature contains a high percentage of air, while thermoformed parts are made from solid plastic sheets. During drop testing these items are subjected to multiple impacts on multiple axes, and hence need enough supporting structure to withstand these forces.

SUMMARY OF THE INVENTION

Embodiments of the invention relate to product cushioning devices for use in packaging shock sensitive products. In particular, in one embodiment, the invention provides a product cushioning device which is made from plastics material and which is particularly intended for use with shock sensitive products such as computers and computer components—particularly hard drives, CD and DVD drives, and the like. Product cushioning structures in keeping with the present invention comprise unitary structures which may be molded from a resilient plastic material, using a variety of molding techniques.

Thus, a purpose of the present invention is to provide protection for shock sensitive devices without employing additional packaging material. In the event that the shock sensitive device is dropped or mishandled, use of the present invention precludes damage to the shock sensitive device.

In the product cushioning device in accordance with the teachings of this invention, there is a product supporting region having a product supporting platform which is arranged to provide support in a mutually perpendicular orientation to the orientations of each of the outer container contacting walls. The product supporting platform is adapted to provide shock absorption support for a product during shock loading conditions in a direction perpendicular thereto, and thus perpendicular to the first or second ones of the three mutually perpendicular directions. Accordingly, shock absorption protection is provided for a shock sensitive product during shock loading conditions, in three mutually perpendicular directions. The product supporting platform has a plurality of ribs formed therein, each extending perpendicularly in a direction away from the product supporting platform to a lower extent limit.

The product support region has a flap hingedly connected to either side. Each flap has corresponding flaps. The flaps fold upwards along the hinge towards the product support region to form a "U" shape to support a series of products between the ribs.

In one embodiment there is at least one flexible shock absorbing spring transition section formed inwardly of each of the outer container contacting walls. The flexible shock absorbing spring transitions sections may include a stiffening rib which extends inwardly from the respective outer container contacting wall towards the product supporting platform. Also, typically each flexible shock absorbing spring section is curved, with the direction of the curve being inwardly and away from the respective outer container contacting wall.

Most notably, the product cushioning device includes cut outs strategically positioned and sized between the product support region and flaps. The cutouts reduce material and thus decrease the overall weight of the product cushioning device. This of course results in improved overall cost savings. This is achieved without compromising impact resistance. One embodiment of the device weighs 270 grams.

Each product support region and flap is preferably joined together at their outer edges merge into one another through angled portions.

In a further embodiment, between the outer edges, each product support region and respective flaps are joined via fold stops. Each fold stop is also integrally joined with a fold stop hinge therebetween. The fold stop hinge also facilitates the upward folding of flaps.

All embodiments of the present invention, as described in greater detail hereafter, provide cushioning and shock force absorption and/or transmission, and thus shock absorbing protection, for whatever product they are being used with.

Thus, according to one aspect, the invention provides a unitary product cushioning device for supporting shock sensitive products during transport in an exterior container, comprising a product support region having a platform; a flap hingedly connected on either side of the product support region for folding upwards and towards the product support region; a plurality of ribs on each flap and product support region, the ribs defining product-supporting cavities therebetween for receiving and supporting the products; a cutout between each flap and product support region. Fold stops may hingedly connect each flap and product support region, the fold stop being angled to facilitate folding of the flap towards the product support region to form a generally "U" shape in the exterior container.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE DISCLOSED EMBODIMENTS

Figure 1:
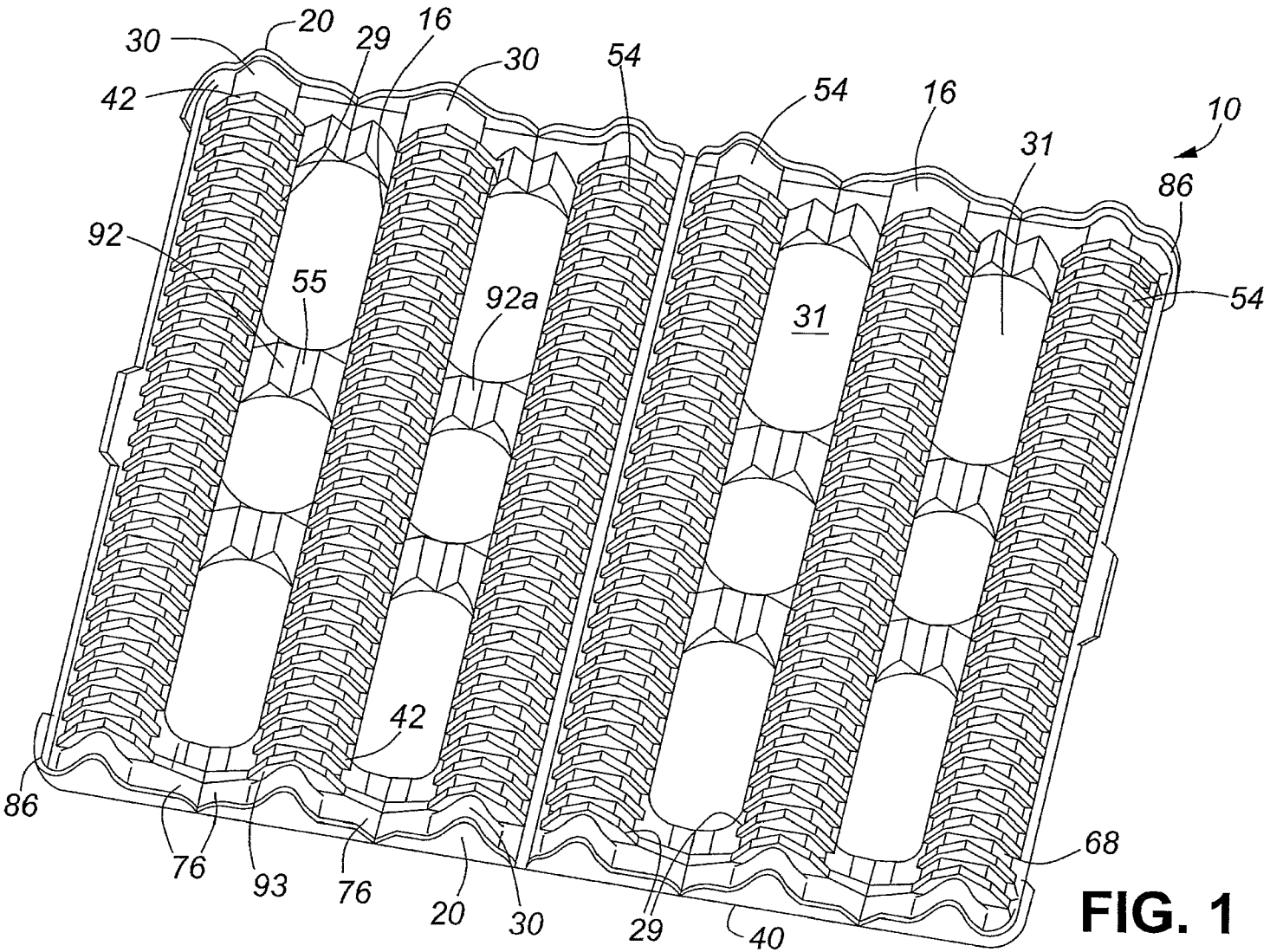
FIG. 1 illustrates a unitary product cushioning device in accordance with teachings of this invention in an unfolded state.
Figure 2:
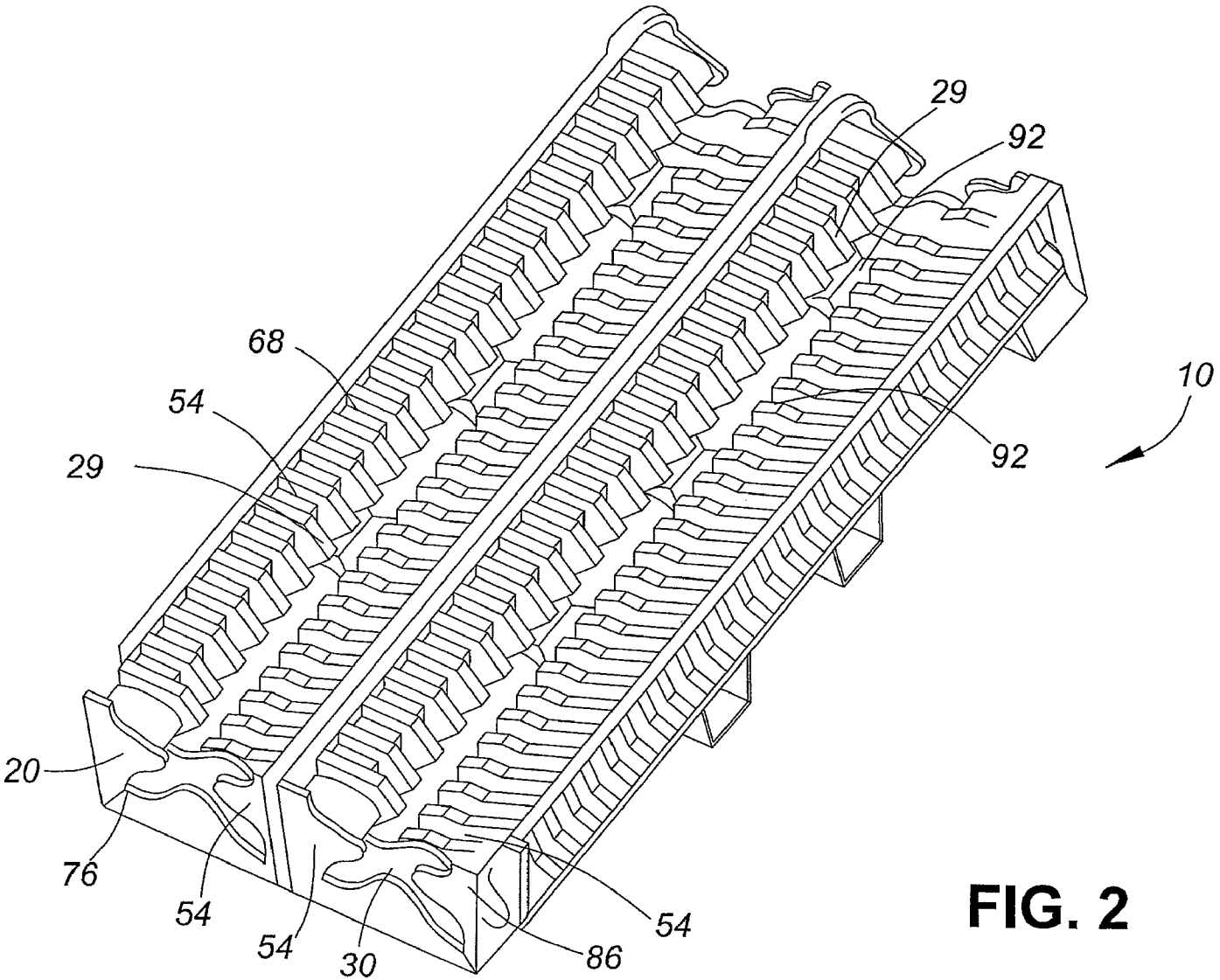
FIG. 2 illustrates the product cushioning device of FIG. 1 in a folded state.

Referring to FIGS. 1 and 2, broadly described, a product cushioning device 10 in accordance with teachings of this invention is made of a single sheet of moldable material formed into two product support regions 16 including a plurality of ribs 29 for positioning and separating each product to be packaged 12 relative to the adjacent product. Generally parallel side edges surrounding each product support region 16 are provided with integrally formed hinged flaps 54. Each flap 54 includes a plurality of ribs 29 projecting inwardly from the inner flap surface thereof. The ribs 29 of the flaps 54 coincide with the ribs 29 on the main product support region 16. The product cushioning device 10 is designed to be placed in a corrugated carton 80. Once placed in a carton 80, the flaps provide protection to the sides of the packaged products. If desired, a lid 9 may be provided to protect the tops of the packaged products 12 as described in detail below. By having two product support regions 16, two rows of products 12 can be secured. However it will be appreciated that the invention also contemplates the use of one product support region 16 with a hinged flap 54 either side to secure a single row of product 12.

Most notably, the product cushioning device includes cut outs 31 strategically positioned and sized between the product support region 16 and flaps 54. The cutouts 31 reduce material and thus decrease the overall weight of the product cushioning device 10. This of course results in improved overall cost savings. The present inventor has found a way to incorporate such cutouts in the product cushioning device 10 without compromising on the impact resistance and strength of the device as is described in detail below.

To facilitate folding of the flaps 54 towards main product support region 16, lower ends of the outermost ribs are formed as angled portions 76. Each product support region 16 and flap 54 is joined together at their outer edges and merge into one another through angled portions 76. The angled portions 76 are angled such as to facilitate the upward folding of each flat 54 towards the product support region 16 to form a generally "U" shape in use.

Further, between the outer edges, each product support region 16 and respective flaps 54 are joined via fold stops 92*a*. Each fold stop is also integrally joined with a fold stop hinge 55 therebetween. The fold stop hinge 55 also facilitates the upward folding of flaps 54. Each fold stop 92*a* is preferably angled at 45 degrees to add support to the product cushioning device 10 to maintain its shape.

The product cushioning structure 10 is preferably formed from a single sheet of plastic by thermoforming, injection molding or equivalent technology. A preferred material for forming the article 10 is medium density polyethylene (MDPE). Specifically, preferably, the material used is 0.045 MDPE. This is obtained by mixing 0.075 and 0.025 MDPE.

Figure 3:
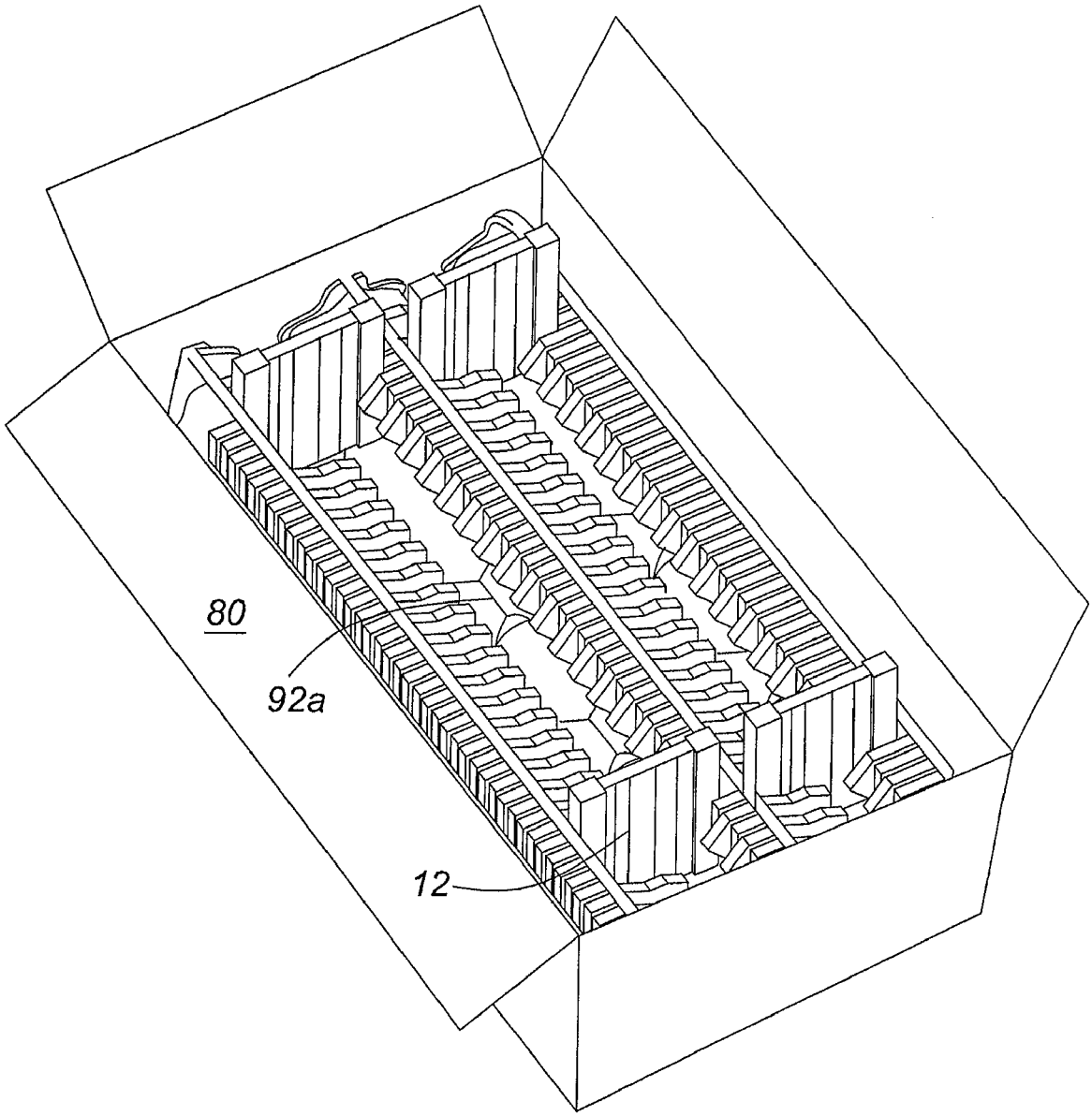
FIG. 3 illustrates the product cushioning device of FIG. 2 in use in an exterior carton.

Referring to FIG. 3, as mentioned above, the product cushioning device 10 is intended for use with a product, the general outline of which is shown at 12. The nature of the product 12 is immaterial to the operation and function of the present invention, except that it will be noted that the product is a shock sensitive product. Typically, such products are electronic products of all sorts, such as laptop computers, computer drives, tape drives, circuit boards, etc. Other products might be assembled computer cases and other assembled electronic products of all sorts, and other manufactured fragile products made of glass or ceramics, for example.

As mentioned above, the product cushioning structure 10 comprises two main product support regions 16 along with two flaps 54 hingedly connected to either side of each main product support regions 16. The main product support region 16 will be described in detail first.

Figure 5:
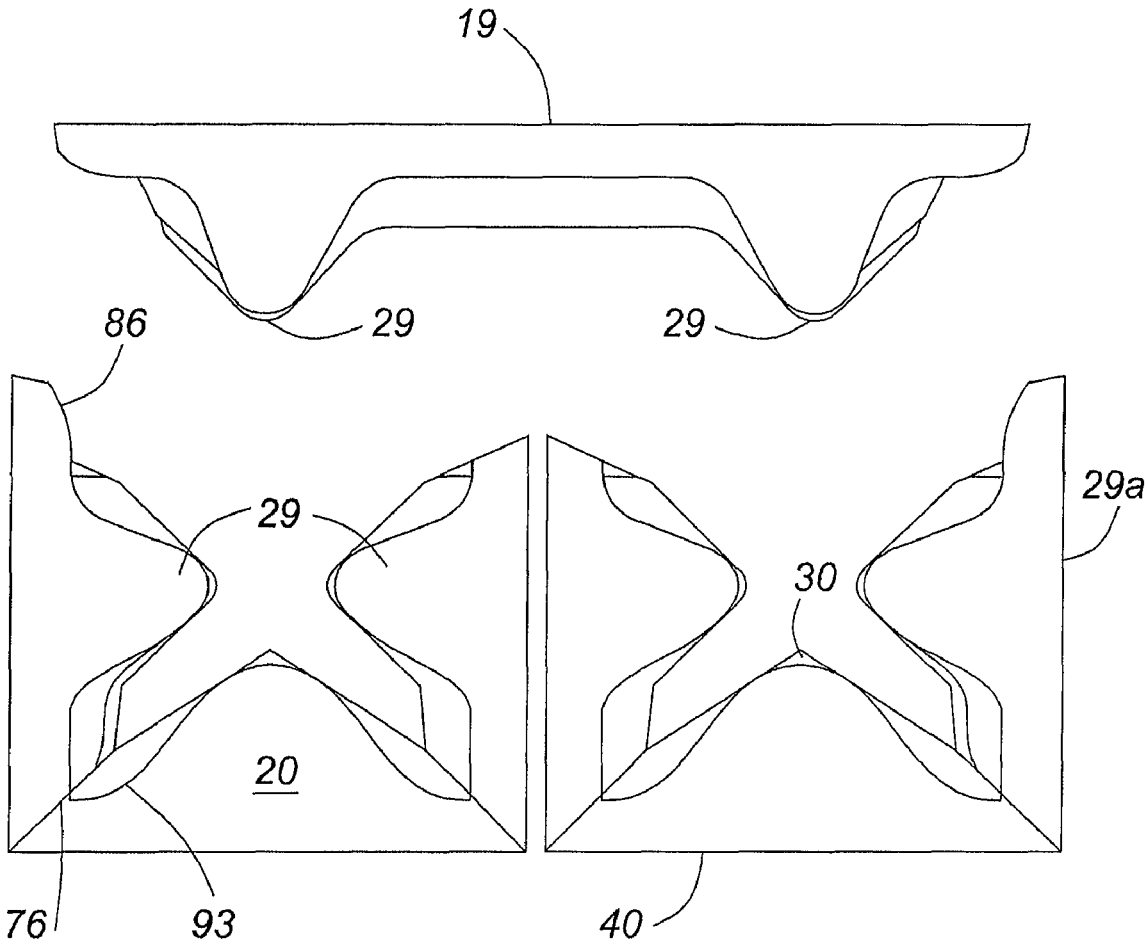
FIG. 5 is a front view of the product cushioning device of FIG. 4.

Referring to FIG. 5, the main product support region 16 has outer container contacting walls 20 along its periphery. The lower portion of the product supporting region 16 terminates in a product supporting platform 28.

Figure 4:
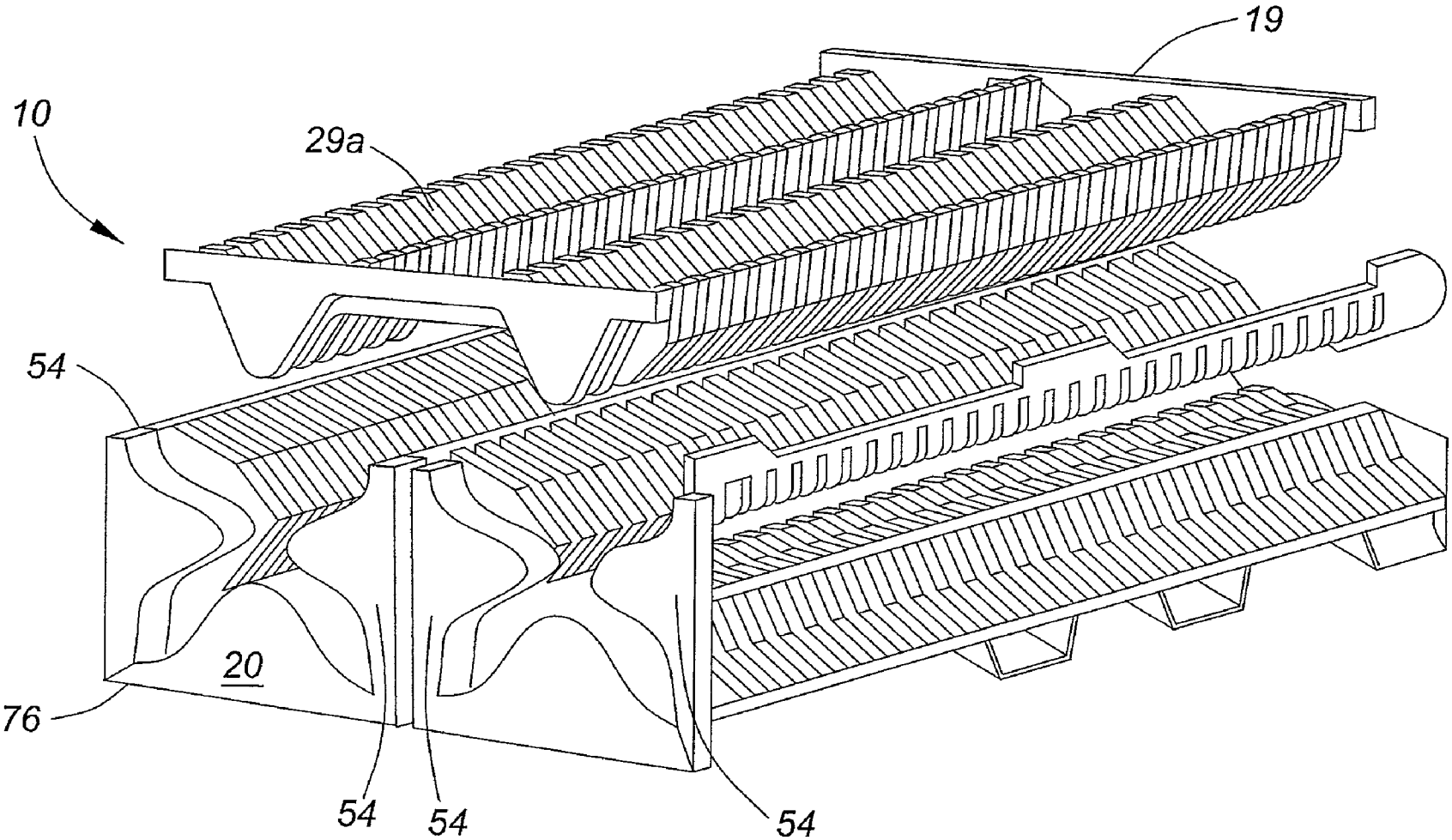
FIG. 4 illustrates the product cushioning device of FIG. 2 showing use of a lid therewith.

The supporting platform 28 comprises a plurality of ribs 29. Ribs 29 project generally vertically from the platform 28 and divide the main product support region 16 into a plurality of product-supporting cavities 68 serving as a lead in or guide for each product 12. The ribs 29 are preferably integrally formed with the structure 10. The ribs 29 function to separate the packaged products 12 from each other and provide a shock absorbing air space between adjacent products. As such, the ribs 29 are substantially triangular in shape, each ending in an apex 92 at the top. The base of each rib 29 ends in a curved portion 93. The shape of the ribs 29 also helps in maintaining the impact resistance of the product cushioning device 10 by defining a shock absorbing air space 29*a* within the rib 29 itself. As seen in FIG. 4, the cavity defined by the underside of each triangular rib 29 is what defines air space 29*a*. The shape of the ribs 29 along with the product-supporting cavities 68 makes loading of the product 12 easier as well.

Also, each of the outer container contacting walls 20 has a bottom edge 40 which provides an outer packaging container contacting surface when placed into a carton 80. The outer container contacting wall at edge 40 contacts a surface of the container 80 in use.

Between each outer container contacting wall 20 and a respective outermost rib 42, there is a flexible shock absorbing spring transition section or sections 30. Typically, each flexible shock absorbing spring transition section 30 has a curved configuration, with the direction of the curve being outwardly and away from the respective outer container contacting wall 20. It will be noted from the drawings that each flexible shock absorbing spring transition section is curved, and the direction of that curve is outwardly and away from the respective outer product container contacting wall 20, to which it is adjacent. It can be seen that the outer corners 86 of the outermost flaps are reinforced by an extension of spring transition section 30 that follows along the corner 86 and terminates at a point just after the corner 86.

Some embodiments of unitary product cushioning structures in keeping with the present invention may be formed in such a manner that the flexible shock absorbing spring transition section 30 is formed in at least two portions, each separated one from another by a stiffening rib (not illustrated). It will be understood, of course, particularly from an inspection of the figures, that the flexible shock absorbing springs sections 30 are curved, with the direction of the curve being inwardly and downwardly, away from the respective outer container contacting wall 20.

As mentioned above, each main product support region 16 is flanked by flaps 54. Each flap 54 is integrally connected to the main product support region 16 by hinges 55. Each flap 54 also has an inner surface thereof for engaging the products 12, and an outer surface 20 for mating with the carton 80. When the flaps 54 are folded up towards the main product support region, the product cushioning device 10 defines a generally "U"-shape when viewed from the front or rear. The flaps 54 must be supported in the generally vertical position by some outside force, such as the adjacent panels of the carton 80.

In one embodiment, the product cushioning device 10 comprises two rows of main product support regions 16. Each main product support region 16 is flanked by hinged flaps 54. This embodiment permits two rows of products 12 to be packaged in the product cushioning device 10. Although embodiments of the invention may contemplate the use of any number of rows as may be suitable or desirable for a given application.

The product cushioning device also includes a lid 9, which is a thermoformed, generally planar panel also provided with ribs 29 that coincide with the ribs 29 in the main product support region 16 and flaps 54. When the lid 9 is placed over the packaged products 12 in the carton 80, the lid 9 will maintain separation of the products 12 from one another by separating the top ends of the products 12. In the embodiment with two main product support regions 16, the corresponding lid 9 is also provided with separated, parallel rows of ribs 29.

It should be appreciated that the size, (width, height and length) of the product cushioning device 10 may vary depending on the particular application and the dimensions of the corresponding carton 80.

It has been noted above that a purpose of the unitary product cushioning structure of the present invention, in any embodiment, is to provide shock absorbing protection for a shock sensitive product, when placed in an outer packaging container. It has been described that any unitary product cushioning structure in keeping with the present invention is formed of a moldable resilient plastics material. The present inventor has found a way to incorporate such cutouts in the product cushioning device 10 without compromising on the impact resistance and strength of the device. Factors affecting the compression strength of the molded unitary product cushioning structures of the present invention are determined by combinations of the transitions 30, ribs 29, angled portions 76, and fold stops 92*a*.

In any event, it is a purpose of the unitary product cushioning structure to provide shock absorption protection in at least two of three mutually perpendicular directions. In its broadest sense, the present invention is adapted to provide shock absorption support for a product during shock loading conditions.

To that end, drop tests on a product cushioning device in accordance with the teachings of this invention have indicated the ability to meet all drop test standards. Those standards vary from case to case, depending on the product to be protected, the size and nature of the product cushioning structure, the nature of the outer packaging container, and so on. A general industry standard is 250 g's is typical.

Below is a table outlining the results of one such test. Each test was conducted in a particular orientation and the maximum g's measured along 3 axes. The drop height was 42", the weight was 15.32 pounds. The box was a single wall box and the material was 0.046 MD.

| Drop Test | Orientation | Axis 1 | Axis 2 | Axis 3 |
|---|---|---|---|---|
| 1 | Main corner | 38.44 | 60.96 | 69.26 |
| 2 | Small edge | 40.53 | 20.80 | 92.58 |
| 3 | Medium edge | 43.36 | 54.58 | 120.68 |
| 4 | Long edge | 47.61 | 58.85 | 14.93 |
| 5 | Small face 1 | 16.32 | 32.12 | 162.88 |
| 6 | Small face 2 | 21.42 | 21.70 | 130.60 |
| 7 | Medium face 1 | 97.27 | 26.21 | 36.76 |
| 8 | Medium face 2 | 96.10 | 18.64 | 17.96 |
| 9 | Large face 1 | 20.24 | 141.14 | 34.67 |
| 10 | Large face 2 | 12.37 | 146.04 | 24.03 |

The results of a second test are below. The drop height was 32", the weight was 28.40 pounds. The box for this test was a double wall and the material was 0.45 MD.

| Drop Test | Orientation | Axis 1 | Axis 2 | Axis 3 |
|---|---|---|---|---|
| 1 | Small face 1 | 64.41 | 23.46 | 91.49 |
| 2 | Small face 2 | 72.72 | 39.74 | 81.72 |
| 3 | Medium face 1 | 77.28 | 25.58 | 19.97 |
| 4 | Medium face 2 | 110.61 | 46.39 | 91.65 |
| 5 | Large face 1 | 26.78 | 78.58 | 68.83 |
| 6 | Large face 2 | 38.78 | 63.78 | 28.33 |
| 7 | Man corner | 29.45 | 24.73 | 88.79 |
| 8 | Small edge | 28.08 | 19.93 | 37.78 |
| 9 | Med edge | 20.76 | 28.46 | 32.08 |
| 10 | Large edge | 36.20 | 24.74 | 30.92 |

The results of a third test are below. The drop height was 38" and the weight was 15.18 pounds. The box for this test was a single wall and the material was 0.045 MD.

| Drop Test | Orientation | Axis 1 | Axis 2 | Axis 3 |
|---|---|---|---|---|
| 1 | 2-3-5 corner | 16.06 | 14.51 | 29.66 |
| 2 | 2-5 edge | 17.59 | 21.30 | 41.85 |
| 3 | 3-5 edge | 10.57 | 27.48 | 53.10 |
| 4 | 3-2 edge | 56.77 | 55.12 | 45.53 |
| 5 | End 5 | 7.92 | 25.30 | 60.33 |
| 6 | Side 2 | 85.05 | 51.53 | 28.71 |
| 7 | Side 4 | 71.29 | 29.25 | 26.71 |
| 8 | Bottom 3 | 18.73 | 162.84 | 30.59 |
| 9 | Top 1 | 40.55 | 143.22 | 74.89 |

It is clear from the above results that the product cushioning device in accordance with the teachings of this invention meets the industry standard of 250 g's.

Numerous modifications may be made without departing from the spirit and scope of the invention as defined in the appended claims.

What is claimed is:

1. A unitary product cushioning device for supporting shock sensitive products during transport in an exterior container, comprising:

a product support region having a platform and a flap on either side of the product support region;

a plurality of ribs on each of the flaps and on the product support region, the ribs defining product-supporting cavities therebetween for receiving and supporting the products;

for each flap, at least two fold stops between the flap and the product support region to keep the flap spaced from the product support region when the cushioning device is flat, the fold stops defining a fold stop hinge to permit each flap to fold upwards and towards the product support region, the fold stops being angled to facilitate folding of each flap towards the product support region to form a generally "U" shape in the exterior container, wherein the fold stops are constructed and arranged to maintain the shape of the unitary product cushioning device; and wherein the at least two fold stops collectively are of a length less than the length of the flap to define a cutout between the at least two fold stops on either side of the product support region, wherein the cutouts serve to reduce the overall material of the unitary product cushioning device; and wherein the device is made of a flexible, thermoformed material.

2. The device of claim 1, wherein the fold stops are angled at 45°.

3. The device of claim 1, wherein the ribs are generally triangular in shape terminating at an apex at the top.

4. The device of claim 3, wherein the underside of each rib defines a shock absorbing air space therein.

5. The device of claim 1, further comprising a lid to place on top of the device after the products have been loaded, the lid comprising a plurality of corresponding ribs to support the products.

6. The device of claim 1, wherein outermost ribs terminate at an angled portion to facilitate folding of the flap towards the product support region.

7. The device of claim 1, wherein the plastic is 0.045 medium density polyethylene.

8. The device of claim 1, wherein there are two product support regions each flanked by flaps, the flaps being hingedly connected to respective support regions to form two rows of product support.

* * * * *